US005460839A

United States Patent [19]

Archibald

[11] Patent Number: 5,460,839

[45] Date of Patent: Oct. 24, 1995

[54] MICROWAVABLE FOOD PACKAGE HAVING A BAG WITH REVERSE FOLDED GUSSETS

[75] Inventor: William E. Archibald, Fullerton, Calif.

[73] Assignee: Hunt-Wesson, Inc., Fullerton, Calif.

[21] Appl. No.: 192,959

[22] Filed: Feb. 7, 1994

Related U.S. Application Data

[63] Continuation of Ser. No. 717,384, Jun. 19, 1991, abandoned.

[51] Int. Cl.[6] ..... B65D 30/20; B65D 25/22

[52] U.S. Cl. ..... 426/107; 426/111; 426/234; 383/120; 219/727

[58] Field of Search ..... 426/107, 111, 426/113, 234, 243; 383/120; 219/727

[56] References Cited

U.S. PATENT DOCUMENTS

| | | | |
|---|---|---|---|
| 304,403 | 9/1884 | Benner | 383/120 |
| 3,107,989 | 10/1963 | Fesco | 383/120 |
| 3,197,118 | 7/1965 | Meyerhoefer | 383/120 |
| 3,297,232 | 1/1967 | Fesco | 383/120 |
| 3,333,523 | 8/1967 | Terzuoli | 383/120 |
| 3,350,859 | 11/1967 | Fesco | 383/120 |
| 3,361,334 | 1/1968 | Terzuoli | 383/120 |
| 3,430,843 | 3/1969 | Fesco | 383/120 |
| 3,457,707 | 7/1969 | Fesco | 383/120 |
| 3,851,574 | 12/1974 | Katz et al. | 426/111 |
| 4,038,425 | 7/1977 | Brandberg et al. | 426/111 |
| 4,450,180 | 5/1984 | Watkins | 426/107 |
| 4,571,337 | 2/1986 | Cage | 426/107 |
| 4,596,713 | 6/1986 | Burdette | 426/107 |
| 4,678,882 | 7/1987 | Bohrer et al. | 426/107 |
| 4,866,786 | 9/1989 | Nagler | 426/107 |
| 4,892,744 | 1/1990 | Ylvisaker | 426/111 |
| 4,904,488 | 2/1990 | Labaw et al. | 426/107 |
| 4,973,810 | 11/1990 | Brauner | 426/107 |

FOREIGN PATENT DOCUMENTS

| | | | |
|---|---|---|---|
| 792593 | 8/1968 | Canada | 383/120 |

*Primary Examiner*—Steven Weinstein
*Attorney, Agent, or Firm*—Pretty, Schroeder, Brueggemann & Clark

[57] ABSTRACT

An expandable collapsed bag, preferably made of paper, suitable for cooking corn in a microwave oven. The bag of the invention has front and back panels and two side panels, each side panel having two or more gussets. These gussets permit relatively free upward movement of the corn and fuller expansion of the bag during cooking. In its collapsed configuration, the back panel is folded to expose a portion of each side panel that forms one gussets. The collapsed bag thereby forms strips extending along each side edge in which the bag is four layers thick. Since a conventionally folded, two gusseted bag has six layers along its edges, the reverse folded bag is thinner and, therefore, advantageous from handling, shipping and storage viewpoints.

10 Claims, 3 Drawing Sheets

MICROWAVABLE FOOD PACKAGE HAVING A BAG WITH REVERSE FOLDED GUSSETS

This application is a continuation of application Ser. No. 07/717,384, filed Jun. 19, 1991, now abandoned.

FIELD OF THE INVENTION

The present invention relates to food products, and more particularly to bags containing popping corn for cooking in a microwave oven.

BACKGROUND OF THE INVENTION

Currently available popcorn intended for cooking in a microwave oven is usually packaged in a two-ply paper bag, which may have a flat bottom or a wedge-shaped bottom. The bag contains a charge of edible ingredients, usually including corn kernels, shortening and sometimes seasoning or flavoring.

The bags are first formed in a bag-making plant and are later filled as part of a separate operation, usually at a different location. The bags should therefore be readily stackable, shipable and be handleable in a mechanized manner.

Since the volume of popped corn is vastly greater than that of the unpopped kernels, the container must have the ability to expand during cooking. For this reason, the bag is capable of unfolding under the internal pressure of the steam released by the exploding kernels and the pressure of the expanding kernels themselves. Bags of this type are described in U.S. Pat. Nos. 4,571,337 (Cage et al.) and 3,851,574 (Katz et al.). Although these patents show bags with flat bottoms, bags with wedge-shaped bottoms are presently more common.

The configuration and construction of the bag should help to maximize the "pop volume" of the corn. Not only does increased pop volume result in a larger volume of edible product (both real and perceived), but it has been found that increased pop volume results in a lighter, fluffier popcorn product with improved textural qualities.

In general, bags with wedge-shaped bottoms containing ready-to-pop corn are of either pinched bottom or tube construction. These two types of bags are similar in most respects, the bottom being formed by bonding together the front and back panels of the bag at their bottom edges. There is thus no separate bottom panel. A typical bag may include a seamless and generally flat front panel, a generally flat back panel with an overlapping seam running its full length at or near its center, and two side panels that connect the front and back panels. The side panels are each folded inwardly to form a gusset that permits the bag to expand. In a pinched bottom bag the sealed bottom edge is folded over itself, whereas in a tube bag there is no such fold at the bottom.

In a typical ready-to-pop bag the edible charge is placed inside the bag, resting on a susceptor that is contiguous with a center section of the front panel. The bag is sealed at the top after filling by bonding together the top edges of the front and back panels. The gussets of the folded bag intrude well into the bag interior, extending between at least some portion of the charge and the back panel. Since the upper and lower sections of the bag remain essentially empty, they are easily flattened and folded over the more bulky center section.

When the still folded bag is to be used, it is placed inside the oven with the center section of the front panel resting on the oven floor, so that the charge rests on the susceptor and the gussets of the side panels overlay a portion of the charge. During cooking, the internal pressure of the steam released by the kernels and the pressure of the popped kernels themselves cause the two end sections of the bag to unfold gradually.

A typical popcorn bag may, however, yield less than the maximum possible pop volume. This common deficiency in bag performance can be attributable, at least in part, to the configuration of the bag and to such factors as the size and stiffness of the gussets.

The gussets intrude into the bag to the greatest extent when the bag is folded flat and the gussets are closed. As the cooking commences, the gussets define a relatively narrow channel between them, which widens as the cooking progresses and the bag expands. The popped kernels must pass through this channel to move vertically into the upper section of the bag. Consequently some of the kernels that are among the first to pop are forced to move laterally a considerable distance toward the center of the bag before they can move upwardly away from the susceptor.

In addition, some kernels break loose from the charge prior to or during cooking and lodge themselves in the folds between the panels and the gussets. In many instances the gussets do not open sufficiently or early enough to release these kernels and allow them to pop properly.

The opening of the gussets as the bag expands is essential to freeing the trapped kernels, but does not, in itself, assure that these kernels return to the susceptor and the center of the bag. The loose kernels are, however, prompted to so move by any rounding of the front panel (on which the bag rests during cooking) that takes place and by the shaking movement of the bag caused by the exploding kernels. The more pronounced the curvature of the front panel, the more tendency the kernels will have to move toward the susceptor.

SUMMARY OF THE INVENTION

The present invention provides a food product comprising an edible charge of popping corn and a bag containing that charge that is suitable for use in a microwave oven. The bag can assume a collapsed configuration for shipping and storage, but expands during cooking to accommodate the volume of the popcorn. The improved design of the bag decreases the number of unpopped kernels and increases the pop volume, thus improving the textural qualities of the corn.

The bag is preferably made of paper. It may have an inner layer of non-wicking greaseproof paper and an outer layer of kraft paper, or it may be of single ply construction. The paper used should have dimensional stability and should be flexible, yet sufficiently stiff to maintain an expanded shape and keep the bag from sagging or drooping after the corn has popped.

The bag can have generally flat front and back panels, and two side panels folded inwardly to form gussets. The front and back panels can be joined to form a bag having a wedge-shaped bottom. A susceptor can be mounted on the front panel.

Advantageously, each side panel forms at least two gussets. This multiple gusset construction, with each gusset being smaller, results in a larger channel at the center of the bag between the gussets that permits relatively free upward movement of the corn as the bag expands. In addition, the multiple gusset construction allows the bag to expand more fully and with less resistance. These features of the bag promote increased pop volume.

When the bag is in its collapsed configuration, the back panel is folded so as to expose a portion of each side panel that forms at least one gusset. The back panel is thus folded along fold lines, thereby defining strips extending along each side edge of the bag in which the bag has a thickness of four layers. A center section of the bag between the strips has a lesser thickness.

Other features and advantages of the present invention will become apparent from the following detailed description, taken in conjunction with the accompanying drawings which illustrate, by way of example, the principles of the invention.

DETAILED DESCRIPTION OF THE PREFERRED EMBODIMENT

An exemplary microwave food product made in accordance with the present invention (shown in FIGS. 1 through 6) consists of an edible charge of popcorn and shortening 10, packed in a bag 12. The bag 12 serves as a cooking container and can function as a convenient serving vessel as well. It is capable of assuming both collapsed and expanded configurations.

The bag 12 is formed from a sheet of single-ply, machine-finished kraft paper treated with a commercially available stain inhibitor, such as a fluorocarbon treatment. Machine glazed papers are also suitable, but more rigid. More compressed papers such as greaseproof and glassine are not as desirable. The optimum paper weight is 35–60 lbs., most preferably about 40 lbs. This preferred weight is less than the total weight of the two plies of bags that are in common use. Lighter paper is conducive to freer bag expansion and improved pop volume, but the paper must be heavy enough to avoid tearing during the bag making and filling processes, and sufficiently stiff to maintain the desired shape in an expanded configuration.

It is also possible to use a bag 12 of two ply construction, as is common today. Preferably the inner layer is then 20–25 lb. greaseproof paper and the outer layer is 20–30 lb. machine-finished paper.

Figure 5:
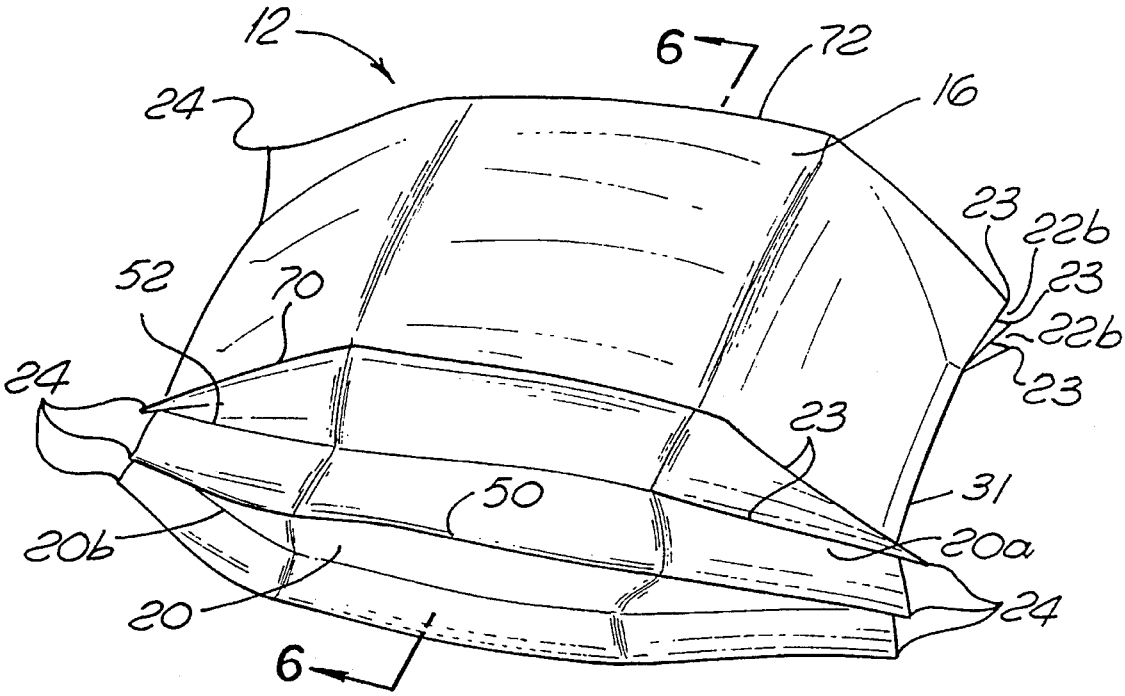
FIG. 5 is an enlarged perspective view of the bag of FIG. 1 after full expansion.
Figure 6:
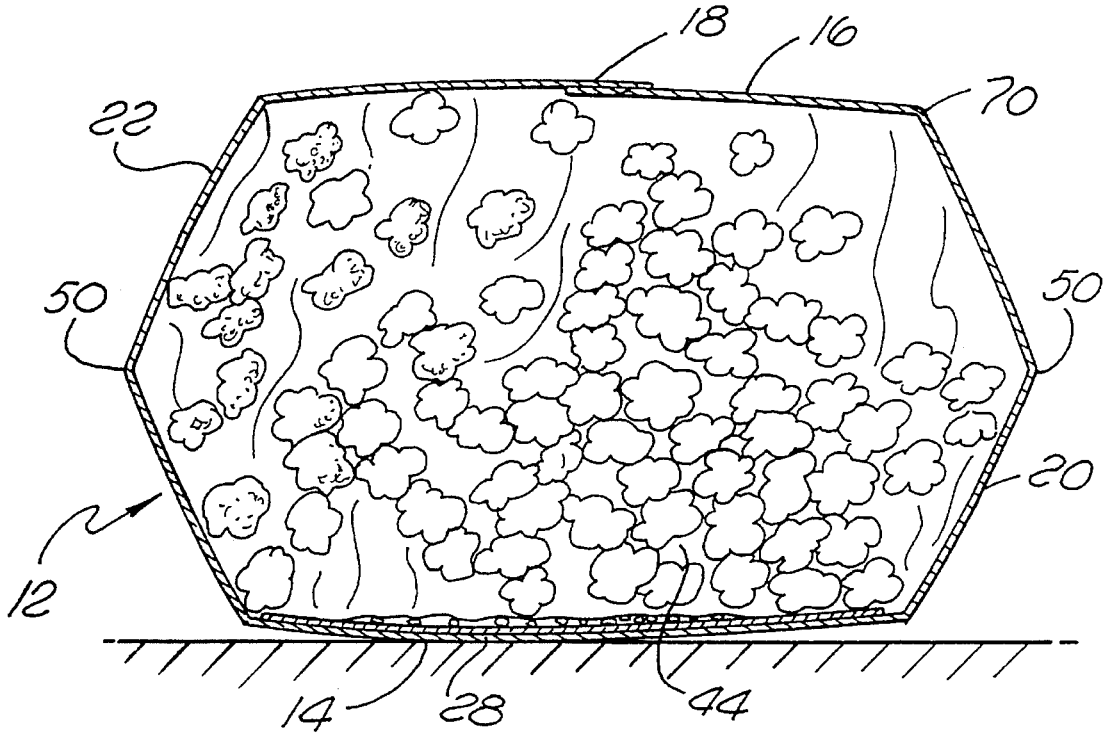
FIG. 6 is an enlarged cross-sectional view of the expanded bag and contents taken along line 6—6 of FIG. 5.

The bag 12 has a generally flat seamless front panel 14, a generally flat back panel 16 of the same size with an overlapping seam 18 running the length of that panel at or near its center, as shown in FIG. 6. Two side panels 20 and 22 that connect the front and back panels 14 and 16 each have two inwardly folding gussets, 20*a* and 20*b*, or 22*a* and 22*b*. Each gusset is defined by fold lines 23 that outline generally elongated rectangular upper and lower sections, as best shown in FIG. 5. The multiple gussets thus have a pleated or accordion-like configuration with a natural resilience or spring-like quality, causing the bag 12 to expand readily and with reduced resistance. This resiliency of the bag 12 is one of the features that can contribute to improved pop volume.

The overall configuration of the bag 12 is that of a tube closed at either end by seams formed by bonding together the inner surfaces at the edges of the front and back panels 14 and 16, and by bonding together the inner surfaces at the edges of the folds in the side panels 20 and 22. Accordingly, the bag 12 can be said to have a wedge-shaped bottom. The two gussets (20*a* and 20*b*, or 22*a* and 22*b*) on each side are of equal size. The gussets of each side panel 20 and 22 are separable along their full length, and the gusset ends or corners 24 at both ends of the bag 12 are thus free to move independently and to separate from each other when the bag is expanded, as shown in FIG. 5. Preferably the seam 18 is not located in the gussets where it could rigidify the bag 12 and inhibit free unfolding movement.

A susceptor 28 is coextensive with the inside of a center section 30 of the bag 12 and is bonded to the exposed inner surface of the bag by a suitable adhesive such as Duraset 12 (Franklin Chemicals) or Airflex 421 (Air Products & Chemicals, Inc.). In the case of a two ply bag, the susceptor 28 may instead be positioned between the plies of the front panel 14.

Figure 4A:
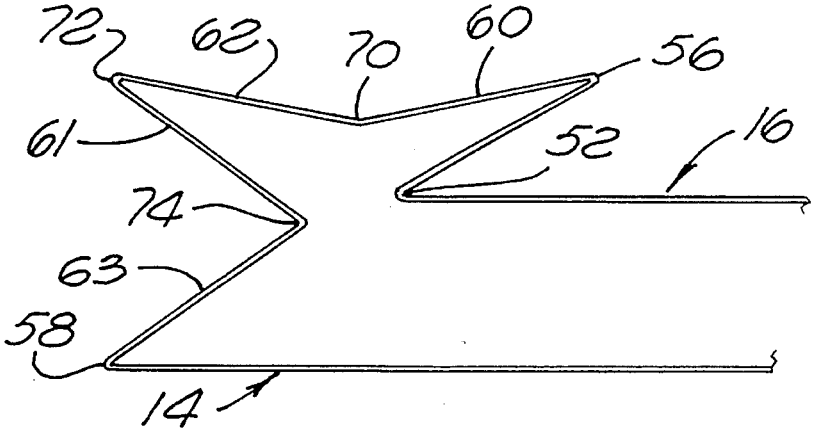
FIG. 4*a* is an enlarged view of a portion of the bag of FIG. 4 shown in a partially collapsed configuration.
Figure 3:
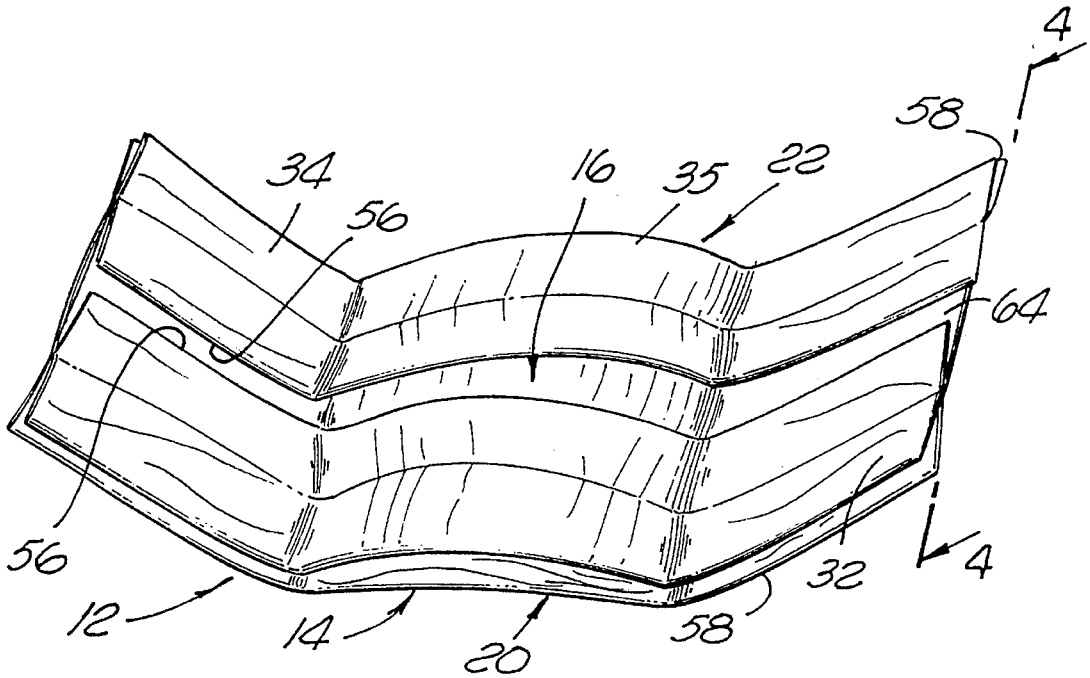
FIG. 3 is an enlarged perspective side and top view of the bag of FIG. 1 in its collapsed configuration.
Figure 4:
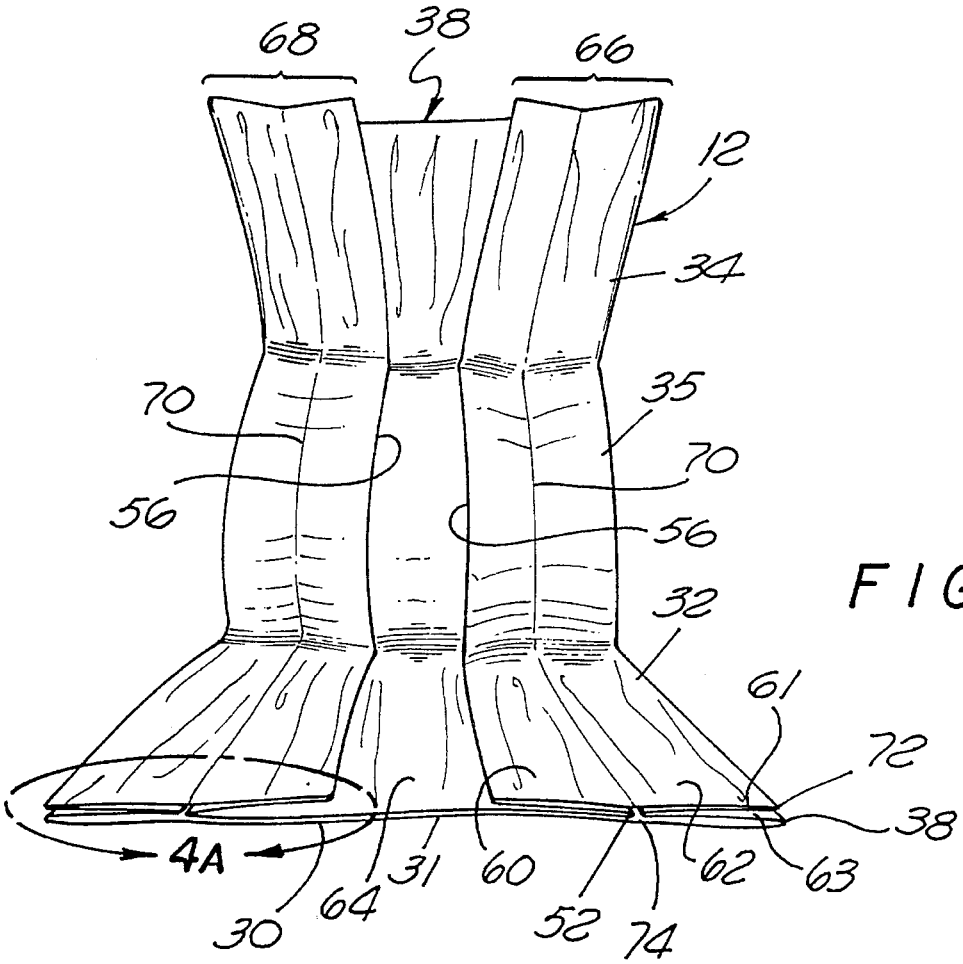
FIG. 4 is an enlarged perspective end and top view of the bag of FIG. 1.

The bag 12, illustrated in FIGS. 3 and 4, is characterized by a reverse folded gusset on each side. To this end, the back panel 16, which faces upwardly when the bag 12 is placed in an oven in the position shown in FIG. 3, is folded along reverse fold lines 52 and 54 that are parallel to the longitudinal edges 56 and 58 of the bag. These reverse fold lines 56 and 58 spaced inwardly from the outer edges of the bag 12 width of a gusset section, i.e., one half the width of a gusset. (The ends of these reverse fold lines 52 and 54 are visible in FIG. 4). Thus the upper and lower sections 60 and 62 of the uppermost gusset on each side are exposed when the bag 12 has not yet expanded. Only a relatively narrow center area 64 of the back panel 16 is exposed between the upper gusset sections 60.

It should be noted that a strip 66, 68 the width of one gusset thus extends along each edge 56, 58 of the collapsed bag 12 on either side of the exposed center area 64 of the back panel 16. Each strip 66, 68 has a thickness of four layers of the paper of which the bag 12 is made, as best shown in FIG. 4. The remaining portion of the folded bag 12, having a thickness of only two layers, is relatively narrow, corresponding to the exposed center area 64 of the back panel 16. No portion of the bag 12 has a thickness of more than four layers.

Two exposed fold lines 70 and 72 extend along the centers of the strips 66 and 68, overlying the fold lines 52 and 54 of the back panel 16, which likewise extend along the centers of the strips. The exposed fold lines 70 and 72 are two of the fold lines 24 mentioned above that outline the sections of the gussets 20*a* and *b* and 22*a* and *b*. When the bag 12 assumes its expanded configuration (FIG. 6), these fold lines 70 and 72 become oblique creases where the side panels 20 and 22 meet the back panel 16.

The construction of the reverse folded gussets can best be seen by reference to FIGS. 3, 4 and 4*a*, which illustrate bag 12 in collapsed and partially collapsed configurations. The bag is made of front panel 14, opposing back panel 16 and two side panels 20 and 22 connecting the front and back panels.

The back panel has a pair of spaced apart longitudinal fold lines 56 delineating an edge between the back panel and each side panel. The front panel also has a pair of spaced apart longitudinal fold lines 58 delineating an edge between the front panel and each side panel.

As best seen in FIG. 4*a*, each side panel has three intermediate, spaced apart longitudinal fold lines, 70, 72, 74, which along with adjacent back and front edges, 58 and 58, respectively, delineate four longitudinal generally rectangular gusset sections, 60, 61, 62 and 63. Gusset sections 60 and 62, the gusset sections adjacent the back edge, form a back gusset, while gusset sections 61 and 63, the gusset sections adjacent the front edge, form a front gusset. The back panel additionally has a pair of spaced apart longitudinal reverse fold lines 52. When the bag is in its collapsed configuration, the back gusset is reverse folded, so that the portions of the back panel located between adjacent reverse fold lines and back edges are pivoted around the reverse fold lines and the portions are positioned substantially adjacent to the remainder of the back panel. When the bag is constructed of single ply paper, this reverse folding results in a bag that, when it is in its collapsed configuration, has a thickness of only four layers in the areas containing gusset sections 60, 61, 62 and 63 and only two layers in the center portion 64 separating the reverse folded gusset sections 60.

If the reverse folded bag 12 is compared with a hypothetical bag that is not reverse folded but has the two gussets on each side or on top of the other, it can be seen that the hypothetical bag would have a maximum thickness of six layers (along the edges) and a much larger center area in which there are only two layers. Because of this difference, a stack of the non-reverse folded bags will be 50 percent higher than a stack of the same number of reverse folded bags 12. Accordingly, the reverse folded bags 12 are advantageous from a handling, shipping and storage viewpoint.

Moreover, a stack of reverse folded bags 12 having a wider area of maximum thickness along the edges and a narrower "void" area of minimum thickness at the center, is relatively stable as compared to a stack of multiple gusset bags that are not reverse folded and therefore have a larger "void." The reverse folded bags 12 are therefore more readily handled, as in a filling process.

When the bag 12 is filled, the edible charge 10 is deposited on the susceptor 28. The lower gussets are then folded inwardly along the fold lines 74 and the upper gussets are reversed folded outwardly by pivoting portions of the back panel along the reverse fold lines 52, thereby closing the lower gussets, opening the upper gussets and flattening the bag 12. The top end 31 of the bag 12 is sealed by applying sufficient heat and pressure across the front panel 14 and the back panel 16 to activate a strip of heat seal coating (not shown) applied to the inner circumference of the bag, bonding together the top edges of the front panel 14 and the rear panel 16. An empty top section 32 and a bottom section 34, adjacent a middle section 35, are then folded transversely to the longitudinal axis of the bag 12, on top of the back panel 16 of the middle section 35. It is preferable that the bag 12 be folded symmetrically so that the top and bottom sections 32 and 34 are of the same size.

Any corn that becomes trapped on top of the gussets (20*a* and *b* and 22*a* and *b*) most likely will not pop as well, or possibly not at all, resulting in reduced pop volume and inferior textural qualities. It should be noted however, that in comparison to a conventional single gusset bag, it is relatively easy to prevent the charge 10 from being deposited on top of the gussets (20*a* and *b* and 22*a* and *b*) when filling the bag 12. The multiple gussets intrude into the bag 12 only about half as far as would a single gusset (See FIG. 4).

It is also important during cooking that the use of multiple gussets leaves a relatively wide channel in the middle of the bag 12 between the opposing gussets (20*a*, 20*b*, 22*a* and 22*b*), again because the gussets do not intrude as far into the bag as in a single gusset bag (See FIG. 4). This wide channel helps to improve the pop volume because most of the kernels, as they pop, can move straight up, without moving laterally to avoid the gussets (20*a* and *b* and 22*a* and *b*). Moreover, if a kernel should be trapped within a relatively shallow gusset, less lateral movement is needed before it can return to the susceptor 28.

If a kernel should be carried upwardly away from the susceptor 28 before it is popped, it is desirable that the kernel move downwardly again, onto the susceptor 28, as soon as possible. The wider channel between the gussets (20*a* and *b* and 22*a* and *b*) further facilitates this downward movement and tends to reduce the time that the kernel is away from the susceptor 28.

It should be noted that a bag with multiple gussets on each side panel 20 and 22 has an outwardly pointed fold 50 (FIG. 6). In contrast, a single gusset bag has only inwardly pointed folds. Outwardly pointed folds not only cause the bag 12 to expand more readily and with less resistance, but allow the side panels 20 and 22 to bulge outwardly to a greater extent. This configuration gives the bag 12 a more pillow-like shape, shown in FIG. 5, the bag being widest at its vertical and longitudinal center point between the front and back panels 14 and 16 (See FIG. 6). As compared to a single gusset bag, the multiple gusset bag 12 becomes more rounded with a more convex bottom formed by the front panel 14. Not only does a bag that expands in this manner have a greater volume, but it is susceptible to more rocking movement during cooking. This rocking movement tends to return unpopped kernels to the susceptor 28, for still more volume and fewer unpopped kernels.

The seams that close the top 30 and bottom 38 of the bag 12 are formed when pressure is applied to heat sealing strips. Sometimes heat is also applied. Though these two seams are similar, the seam at the bottom end 38 is able to withstand higher internal pressures and temperatures than the seam at the top end 30. This causes the top seam to open and vent steam before any other seam (including the overlapping seam 18 running the length of the back panel 16) as the pressure and temperature inside the bag 12 increases. The preferred manner in which steam is vented is described in more detail in U.S. Pat. No. 4,571,337.

Preferably, the kernels of the charge 10 are all of approximately equal size so that substantially all kernels will pop uniformly and within a limited time, the popping time in a microwave oven being partially dependent on kernel size. Since popping is attributable to the moisture content of the kernels, it is also important that there be sufficient moisture. The moisture content of the kernels should be between 13 to 14 percent by weight (13.5 percent being optimal) and no less than 11.5 percent. Too little moisture results in small popped kernels the density of which is too high for the fluffy texture desired.

The shortening in the charge 10 is a solid at room temperature. Since no refrigeration is required for any of the ingredients, the product can be described as shelf-stable.

Figure 1:
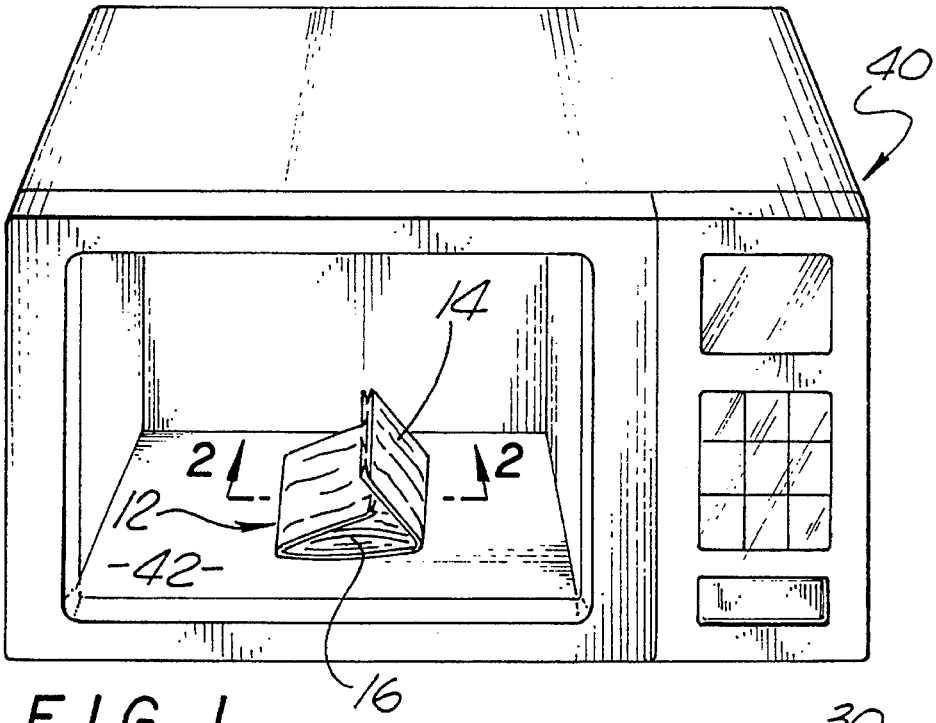
FIG. 1 is a perspective view of a bag of popcorn when first placed in a microwave oven in a collapsed configuration.
Figure 2:
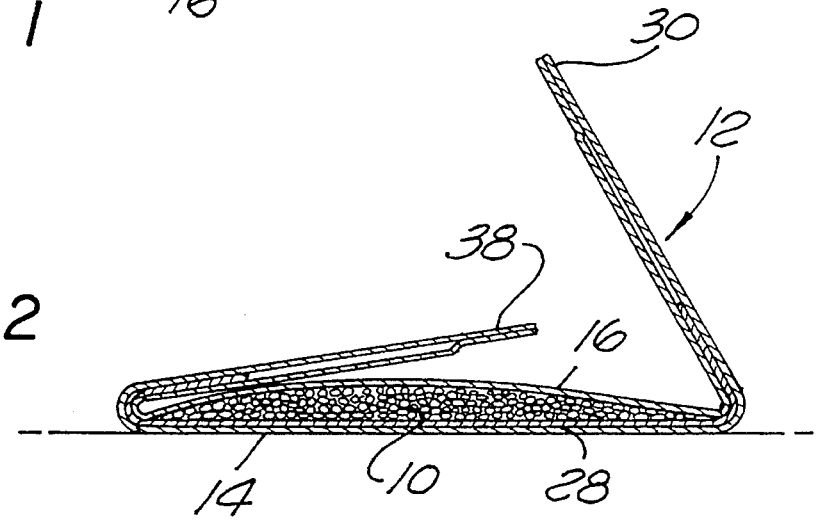
FIG. 2 is a cross-sectional view of the bag of FIG. 1 and contents taken along a line 2—2.

When the folded bag 12 is ready for use, it is placed in a microwave oven 40 with its front panel 14 resting on the oven floor 42 (as shown in FIG. 1) so that the susceptor 28 is positioned underneath the charge 10. Microwave energy is absorbed by the corn kernels of the charge 10. The moisture content of the kernels turns to steam, which causes the kernels to explode or "pop," releasing the steam inside the bag 12. As the number of popped kernels increases during cooking, the pressure of the steam released by the popped kernels and that of the popped kernels 44 themselves increases. This pressure causes the empty end sections 32 and 34 on either side of the charge 10 to unfold, thereby straightening the bag 12 and extending it horizontally, and causing the gussets (20*a* and *b* and 22*a* and *b*) to open gradually, as shown in FIGS. 3 and 5. To permit free and unrestricted popping action, thus minimizing the number of unpopped kernels, the internal steam pressure must create sufficient vertical space 46 above the charge 10 to allow the kernels to move off the susceptor 28 as they pop.

The popping action has the beneficial effect of shaking the bag 12 as the exploding kernels impact the walls of the bag. As the expanding bag 12 assumes an increasingly spherical shape, the exterior surface of the front panel 14 (on which the bag rests) becomes progressively more rounded, as shown in FIG. 6, thus facilitating the rocking motion of the bag caused by the impact of exploding kernels. The shaking of the bag 12 encourages any remaining unpopped kernels that have moved off the susceptor 28 to roll back onto the susceptor, located at what becomes the low point at the bottom of the bag.

While a particular form of the invention has been illustrated and described, it will be apparent that various modifications can be made without departing from the spirit and scope of the invention. Accordingly, it is not intended that the invention be limited, except as by the appended claims.

I claim:

1. A food package comprising:

a bag in a collapsed configuration and capable of assuming an expanded configuration, said bag containing an edible charge of popping corn for cooking in a microwave oven, said bag comprising:

a front panel upon which said charge rests when said bag is placed in said microwave oven;

a back panel opposing said front panel; and two side panels connecting said front and back panels, wherein said front panel has a pair of spaced apart longitudinal first fold lines, each first fold line delineating an edge between said front panel and each of said respective bordering side panels, and said back panel has a pair of spaced apart longitudinal second fold lines, each second fold line delineating an edge between said back panel and each of said respective bordering side panels, each of said side panels has at least three intermediate, spaced apart longitudinal fold lines located between adjacent first and second fold lines, such that the adjacent first and second fold lines along with their associated intermediate fold lines delineate at least four longitudinal generally rectangular gusset sections on each of said side panels, the pair of adjoining gusset sections closet each first fold line forming a first gusset and the pair of adjoining gusset sections adjacent each second fold line forming a second gusset, and wherein said back panel further has a pair of spaced apart longitudinal reverse fold lines, each reverse fold line spaced from said respective adjacent second fold line, such that the portions of said back panel located between adjacent said respective reverse fold lines and said respective second fold lines are pivoted around said reverse fold lines and are positioned substantially next to the remainder of said back panel, such that said second gussets are opened and said gusset sections forming said second gussets are positioned substantially planar to said back panel.

2. The food package of claim 1, further comprising a microwave susceptor mounted on an interior surface of said front panel.

3. The food package of claim 1, wherein said bag has a wedge-shaped bottom formed by joining said front and back panels.

4. The food package of claim 1, wherein each of said side panels has three intermediate spaced apart longitudinal fold lines delineating four longitudinal generally rectangular gusset sections on each of said side panels.

5. The food package of claim 1, wherein said bag is of single ply construction.

6. The food package of claim 1, wherein said bag is formed of a single ply of machine finished paper.

7. The food package of claim 6, wherein said collapsed bag has a maximum thickness of four layers of paper.

8. The food package of claim 6, wherein said collapsed bag has a center portion between said reverse folded gussets.

9. The food product of claim 8 wherein said center portion has a thickness of two layers of paper.

10. The food package of claim 1, wherein said collapsed bag has a center portion between said reverse folded gussets.

* * * * *

UNITED STATES PATENT AND TRADEMARK OFFICE

CERTIFICATE OF CORRECTION

PATENT NO. : 5,460,839
DATED : October 24, 1995
INVENTOR(S) : William E. Archibald It is certified that error appears in the above-indentified patent and that said Letters Patent is hereby corrected as shown below:

Column 8 ,line 10: "closet" should be "closest"
Column 8, line 44: "product" should be "package"

Signed and Sealed this
Sixth Day of February, 1996

Bruce Lehman

*Attest:*

BRUCE LEHMAN

*Attesting Officer*

*Commissioner of Patents and Trademarks*